US008402586B2

(12) United States Patent
Lavabre

(10) Patent No.: US 8,402,586 B2
(45) Date of Patent: Mar. 26, 2013

(54) MOTORISED ROBOT FOR CLEANING SWIMMING POOLS OR THE LIKE, WHICH OPERATES WHEN SUBMERGED IN A FLUID

(75) Inventor: Vincent Lavabre, Balma (FR)

(73) Assignee: P.M.P.S. Technologies, Quint-Fonsegrives (FR)

( * ) Notice: Subject to any disclaimer, the term of this patent is extended or adjusted under 35 U.S.C. 154(b) by 0 days.

(21) Appl. No.: 13/129,248

(22) PCT Filed: Nov. 10, 2009

(86) PCT No.: PCT/FR2009/052168

§ 371 (c)(1),
(2), (4) Date: Jul. 6, 2011

(87) PCT Pub. No.: WO2010/055259

PCT Pub. Date: May 20, 2010

(65) Prior Publication Data

US 2011/0258789 A1 Oct. 27, 2011

(30) Foreign Application Priority Data

Nov. 14, 2008 (FR) ..... 08 06347

(51) Int. Cl.
*E04H 4/16* (2006.01)

(52) U.S. Cl. ..... 15/1.7

(58) Field of Classification Search ..... 15/1.7; 210/167.1, 167.16, 167.17, 416.2, 459
See application file for complete search history.

(56) References Cited

U.S. PATENT DOCUMENTS 5,197,158 A 3/1993 Moini
5,337,434 A * 8/1994 Erlich ..... 15/1.7
6,412,133 B1 * 7/2002 Erlich et al. ..... 15/1.7

FOREIGN PATENT DOCUMENTS

EP 0 352 487 A1 1/1990

* cited by examiner

*Primary Examiner* — Mark Spisich
*Assistant Examiner* — Andrew A Horton
(74) *Attorney, Agent, or Firm* — Birch, Stewart, Kolasch & Birch, LLP

(57) ABSTRACT

The invention relates to a motorized robot for cleaning swimming pools, including: means (2) for moving the robot, having a surface (3) for making contact with a movement surface submerged in the swimming pool; means (4) for generating a circulation of fluid in the robot, including an opening for the suction (5) of said fluid, and an opening for the backflow (6) of the aspirated fluid; a conduit (7) of fluid connecting the suction and backflow openings; means for generating (8) a flow of said fluid in the conduit; a strut for lifting at least part of the contact surface (3) from the movement surface, said strut being mobile between a first inactive position in which the strut is retracted inside the robot and a second active position in which the strut projects past the contact surface of the movement means in such a way that part of said contact surface can no longer be in contact with the movement surface; and means for controlling (10) the movement of the strut between its active and inactive positions, said means being activated by a movement of the fluid in the fluid conduit, and including means (11) for opposing the movement of the fluid in the fluid conduit (7), which are mobile in said conduit in such a way as to at least partially block the conduit or release it, and connected to the strut in such a way that the strut takes on its active or inactive position according to the position adopted in the fluid conduit by the opposition means.

7 Claims, 8 Drawing Sheets

MOTORISED ROBOT FOR CLEANING SWIMMING POOLS OR THE LIKE, WHICH OPERATES WHEN SUBMERGED IN A FLUID

The present invention pertains to a motorized robot for cleaning swimming pools or the like, which operates submerged in a fluid, comprising:

- displacement means for the robot, of the wheel, brush, or caterpillar type, comprising a surface of contact with a submerged surface of displacement of said swimming pool or the like,
- means for generating, through the robot, a circulation of the fluid in which the robot is submerged, comprising:
  - an aspiration opening for said fluid,
  - a discharge opening for the aspirated fluid,
  - a fluid conduit linking the aspiration and discharge openings,
  - means generating a stream of said fluid in said conduit,
- a strut for lifting from the displacement surface, at least one part of said contact surface of the displacement means, the strut being movable at least between the following two positions:
  - a first position, termed the inactive position, in which the strut is retracted inside the robot, the contact surface of the displacement means then being able to be entirely in contact with said displacement surface,
  - a second position, termed the active position, in which said strut stands proud of the contact surface of the displacement means, so that a part of this contact surface can no longer be in contact with the displacement surface.

Such robots are known from the prior art. The function of the strut is to allow a change of direction of displacement of the robot, when said strut is actuated, that is to say when it has exited its housing so as to place itself in a position proud of the surface of contact of the robot with the displacement surface; having exited, the strut serves as point of pivoting of the robot thereabout under the effect of maintaining the displacement means activated i.e. the rotation of the wheels, brushes, or caterpillars of the robot; when the strut has returned into its housing and is thus retracted inside the robot below the contact surface, the latter no longer has any effect since it is no longer in contact with the displacement surface, and the robot takes a new direction defined by its angular position about the axis of rotation given by the strut at its point of exit, at the moment of the retracting thereof when the contact surface of the displacement means for the robot once again bears completely on the displacement surface of the swimming pool or the like. The strut is controlled by an electric actuator of electric motor type, the control of which responds to a defined frequency which may be random; such a control means exhibits the drawback of giving rise to the installation of an additional motor in the robot.

Such robots thus make it possible to generate through them a stream of the fluid in which they are submerged, while moving, on the horizontal and/or vertical surfaces of the swimming pool or the like, depending on the robot; the fluid stream thus generated makes it possible to filter the water in the robot, to remove waste and impurities therefrom, and therefore to eject the water from the latter after having cleaned it. The fluid stream through the robot is sometimes devised in such a way that it participates, in general via the direction of its discharge conduit, in the adhesion of the robot to the displacement surface, and therefore to its displacement force, in particular on the vertical surfaces.

The means for displacing such robots of the prior art generally adopt the form of two or more displacement motor sets, controlled by one or more actuators of the electric motor type depending on the chosen mode of change of direction of displacement of the robot, which actuate wheels, caterpillars, or brushes each adopting the form of a rotary roller.

Robots with three motors, one for each displacement set and one for generating the hydraulic flow, require sophisticated and expensive control electronics. The two motors for the two displacement sets, respectively, are used for the change of direction of the robot, by differential rotation of the sets, which change of direction is performed in an alternative manner by virtue of the strut on other types of robot.

Robots with two motors, one common for the displacement set or sets, and one for the hydraulic flow, make it possible to turn by stopping the pump, giving rise, by virtue of an imbalance of flotation of the robot and of the elimination of the floor contact force given by the discharging of the flow, to a lateral inclination of the robot which now bears on only one side of the displacement means, thereby giving rise to a rotation of the robot about itself under the effect of the rotation of the displacement set or sets; the reactivation of the hydraulic flow pushes the robot hard against the floor again and it can resume a substantially straight direction of displacement. This type of robot, reliable and of reduced production cost on account of the presence of only two motors, operates poorly on vertical walls, however.

As we have seen above, the strut-type robots of the prior art possess a minimum of three motors, one for control of the strut, one for displacement, and one for the hydraulic flow, thereby correspondingly increasing the production cost and the risk of breakdown.

The objective of the present invention is essentially to alleviate these drawbacks. More precisely, it consists of a robot, such as defined above, for swimming pools or the like, which is characterized in that it furthermore comprises means for controlling the displacement of said strut which are activated by a motion of the fluid in said fluid conduit, said means for controlling the displacement of said strut between its active and inactive positions comprising means for opposing the motion of the fluid in the fluid conduit, which are movable in the latter so as to at least partially obstruct said conduit or to clear it, and are tied to the strut, in such a way that, depending on the position adopted in the fluid conduit by said opposing means, the strut takes its active or inactive position.

The present invention thus offers a robot comprising a strut without having the drawback of such a technology, by virtue of a hydraulic actuator of the strut using the motion of the fluid passing through the robot. In robots with three motors defined above, the present invention makes it possible to eliminate a motor for the displacement sets, on account of the change of direction of the robot by means of the strut, without having to add a motor for its operation. In robots with two motors defined above, the present invention allows improved adhesion at vertical surfaces on account of the presence of a strut as replacement for the imbalance of flotation for the change of direction of the robot, but without having to add an extra motor. For strut-type robots, the present invention makes it possible to reduce the number of motors, and therefore the cost of these robots and increases their reliability. The means for opposing the motion of the fluid in the fluid conduit make it possible to use the energy of the fluid passing through the robot to control the operation of the strut. The fluid must overcome a resistance from the opposing means in order to control displacement of the strut between its two positions.

According to an advantageous characteristic, said means for opposing the motion of the fluid in the fluid conduit, which are movable in the latter and are tied to the strut, comprise:

movable-blade means, tied to the strut, and disposed in said fluid conduit, and movable between at least the following two positions:

a first so-called active position, adopted under the effect of a displacement of said fluid in the conduit giving rise to an at least partial withdrawal of the movable-blade means in the conduit, and in which said strut is then in its inactive position retracted in the robot, a second so-called inactive position, adopted when no fluid is moving in the conduit, giving rise, under the effect of an elastic restoring means, to a position of the movable-blade means across said fluid conduit, and in which said strut then stands proud in its active position.

According to this characteristic, the fluid must overcome the elastic restoring means when it displaces the movable-blade means opposing the passage of the fluid in the fluid conduit, so as to control the passage of the strut from its active position to its inactive position. When the fluid flow through the robot is halted, the elastic restoring means restores the blade across the conduit and propels the strut beyond the surface of contact of the displacement means for the robot with the displacement surface so as to lift it locally from the latter.

According to an advantageous characteristic, said movable-blade means are mounted rotatably in the fluid conduit.

This characteristic makes it possible to optimize the use of the hydraulic energy provided by the hydraulic flow in the fluid conduit.

According to an advantageous characteristic, said means for opposing the motion of the fluid are disposed in a part of the fluid conduit, termed the discharge conduit, situated between the means generating the fluid stream in the internal conduit and the discharge opening.

This characteristic makes it possible to optimize the use of the hydraulic energy provided by the hydraulic flow in the fluid conduit.

According to an advantageous characteristic, said discharge conduit is perpendicular or substantially perpendicular to the contact surface of the displacement means for the robot.

This characteristic is useful for allowing the robot good adhesion at vertical displacement surfaces. The energy tapped off for the control of the strut makes it possible to maintain this advantage.

According to an advantageous characteristic, the means for controlling the displacement of the strut between its active and inactive positions comprise an intermediate transmission link-bar articulated at one of its ends to the strut and at the other of its ends to said movable-blade means, and said intermediate transmission link-bar is devised in such a way that the displacement of the strut is degressive when the blade means pass from their inactive position to their active position.

According to an advantageous characteristic, the means for controlling the displacement of the strut between its active and inactive positions comprise an intermediate transmission lever between one of the elements, chosen from among the following: strut, intermediate link-bar, movable-blade means, and said elastic restoring means, said intermediate lever being devised in such a way that the load for tensioning the elastic restoring means, exerted by the fluid on the blade means, is constant or substantially constant, when the latter move from their inactive position to their active position.

The above characteristics make it possible to optimize the management of the loads exerted by the hydraulic flow on the control means of the strut, as a function of the position of the blade means in the conduit, with respect to the hydraulic flow.

Other characteristics and advantages will become apparent on the following reading of an exemplary embodiment of a robot for cleaning swimming pools according to the invention, accompanied by the appended drawings, which embodiment is given by way of nonlimiting example.

FIG. 1 represents a perspective overall view from above of an exemplary embodiment of a robot for cleaning swimming pools or the like.

Figure 1:
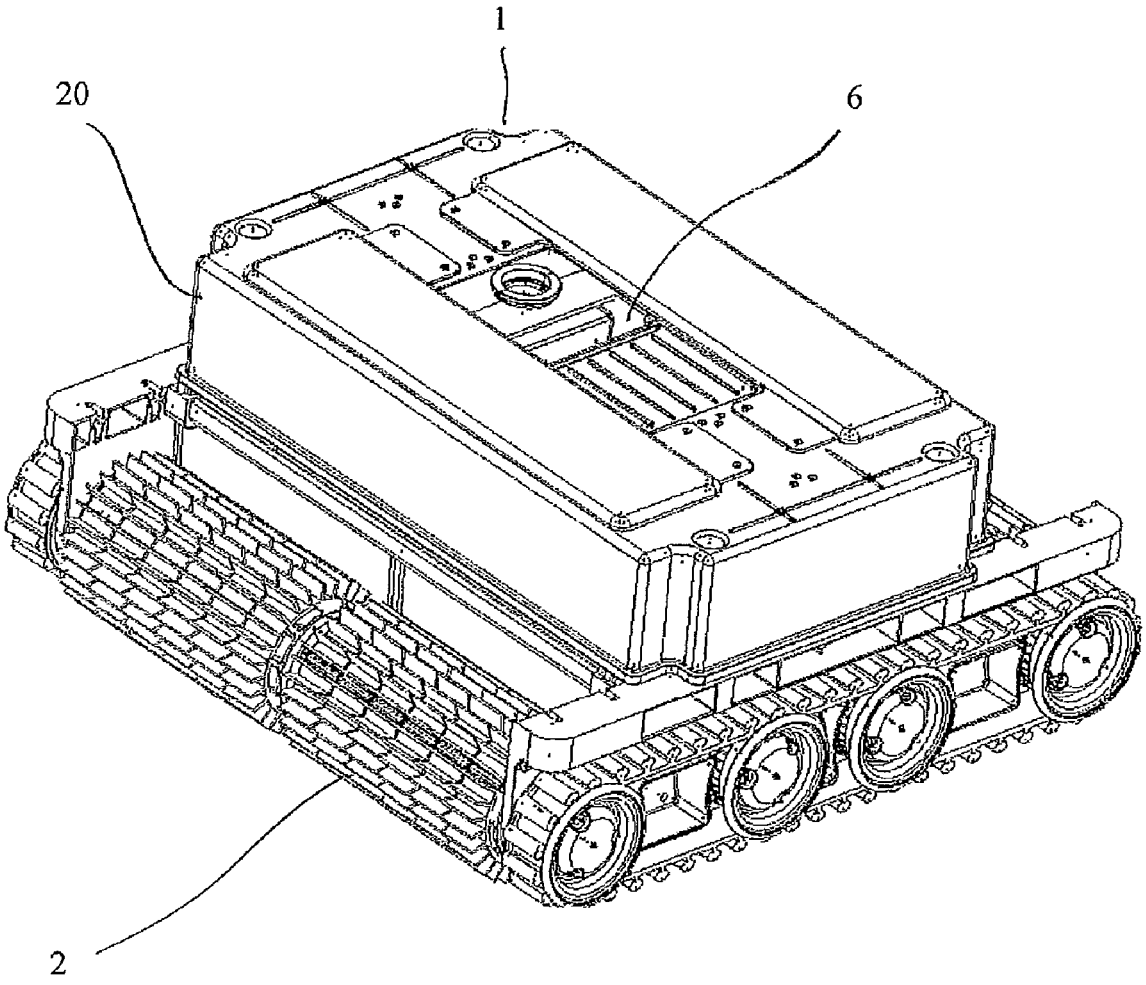
Figure 5:
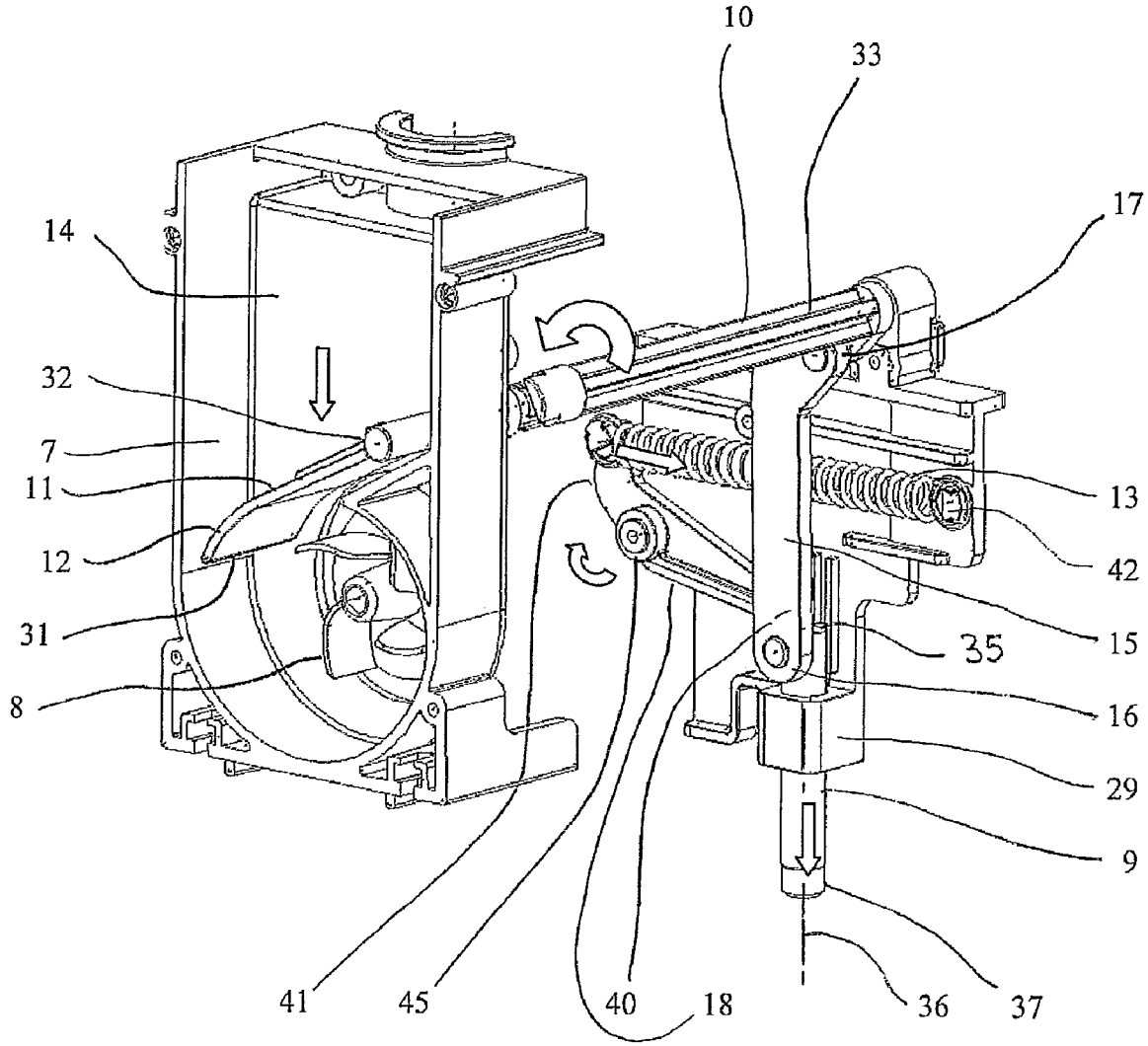
FIG. 5 represents a magnified detail in perspective of the example of FIG. 1, relating to the means for controlling the strut to an active position of the latter.
Figure 6:
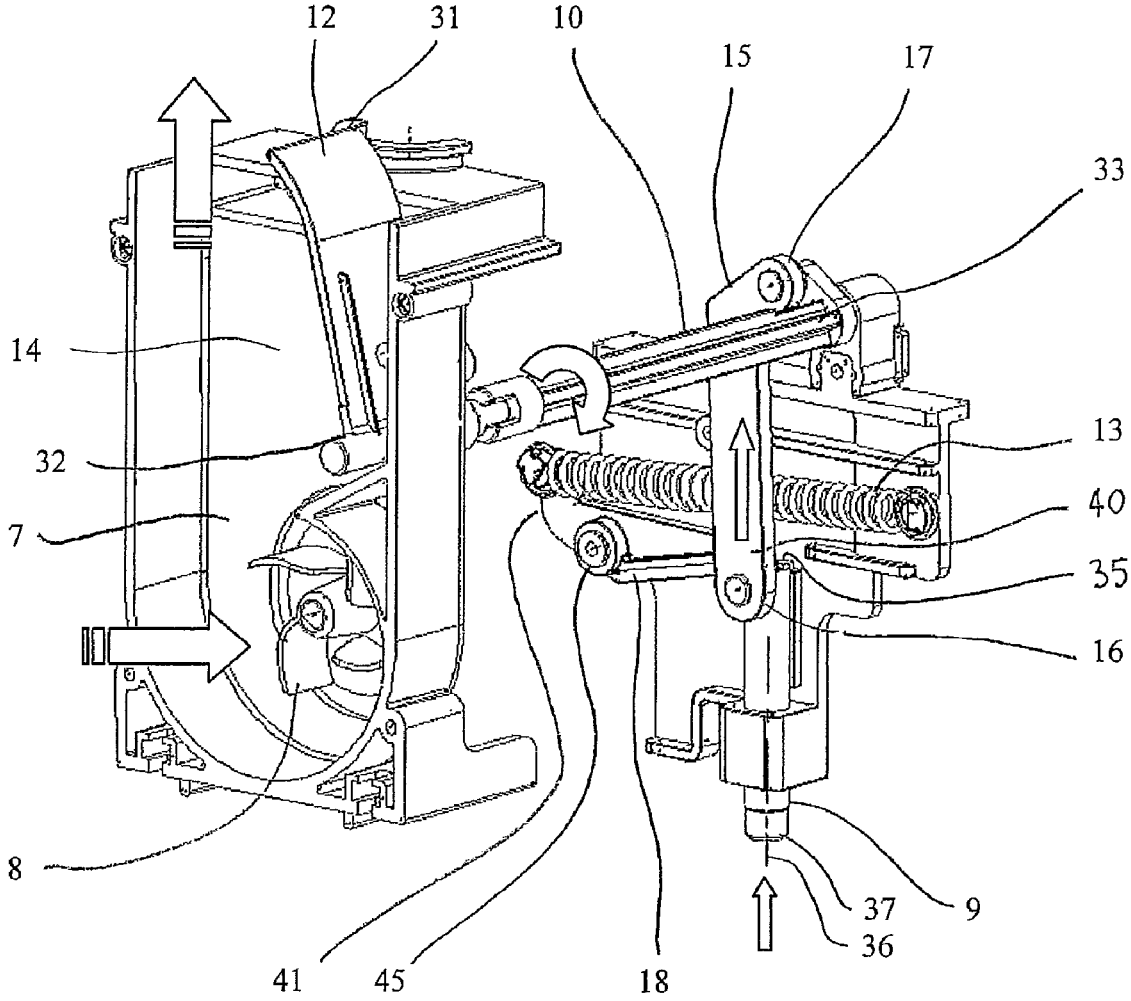
FIG. 6 represents the detail of FIG. 5, relating to the means for controlling the strut to an inactive position of the latter.
Figure 7:
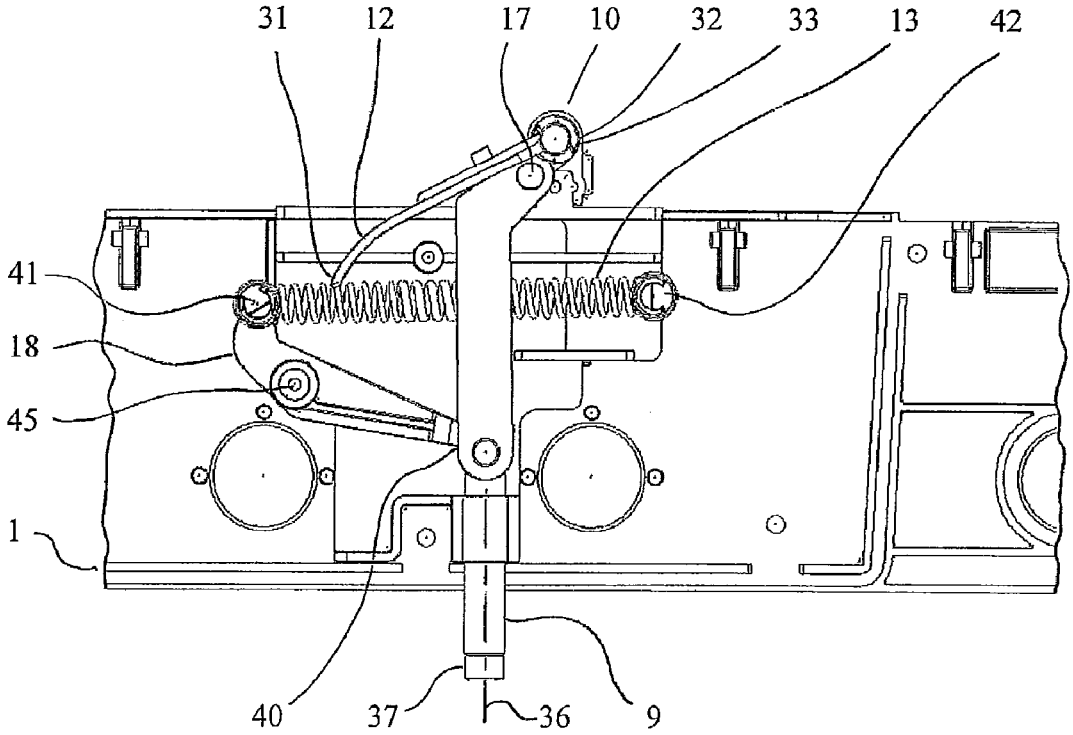
FIGS. 7 to 9 represent respectively in a side view three different kinematic positions of the control means of the strut.
Figure 9:
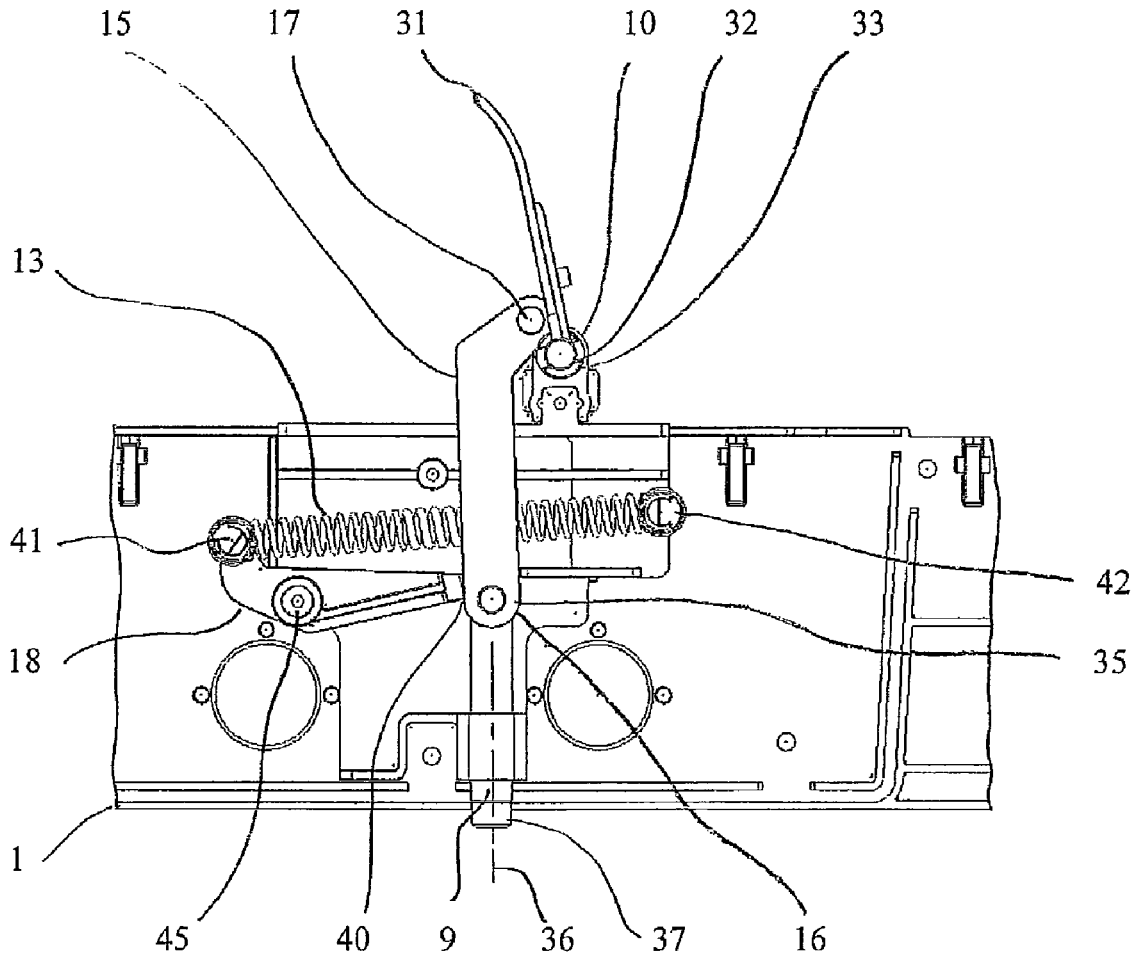

The robot represented in the figures is a motorized robot 1 for cleaning swimming pools or the like (not represented), for example any basin filled with fluid and comprising horizontal, vertical or other walls, which operates submerged in a fluid, and comprises:

displacement means 2 for the robot, of the brushes 22 and caterpillars 30 type, comprising a surface 3 of contact with a submerged surface of displacement of the swimming pool or the like, means 4 for generating, through the robot, a circulation of the fluid in which the robot 1 is submerged, comprising:

an aspiration opening 5 for the fluid, a discharge opening 6 for the aspirated fluid, a fluid conduit 7 linking the aspiration and discharge openings, means 8 generating a stream of the fluid in the conduit, a strut 9 for lifting from the displacement surface, at least one part of the contact surface of the displacement means 2, the strut 9 being movable at least between the following two positions:

a first position, termed the inactive position, as represented in FIG. 6 or 9, in which the strut 9 is retracted inside the robot 1, the contact surface of the displacement means 2 then being able to be entirely in contact with the displacement surface, a second position, termed the active position, as represented in FIG. 5 or 7, in which the strut 9 stands proud of the contact surface of the displacement means 2, so that a part of this contact surface, situated around the strut as a function of the location of the latter, can no longer be in contact with the displacement surface, means 10 for controlling the displacement of the strut 9 and which are activated by a motion of the fluid in the fluid conduit 7.

Figure 2:
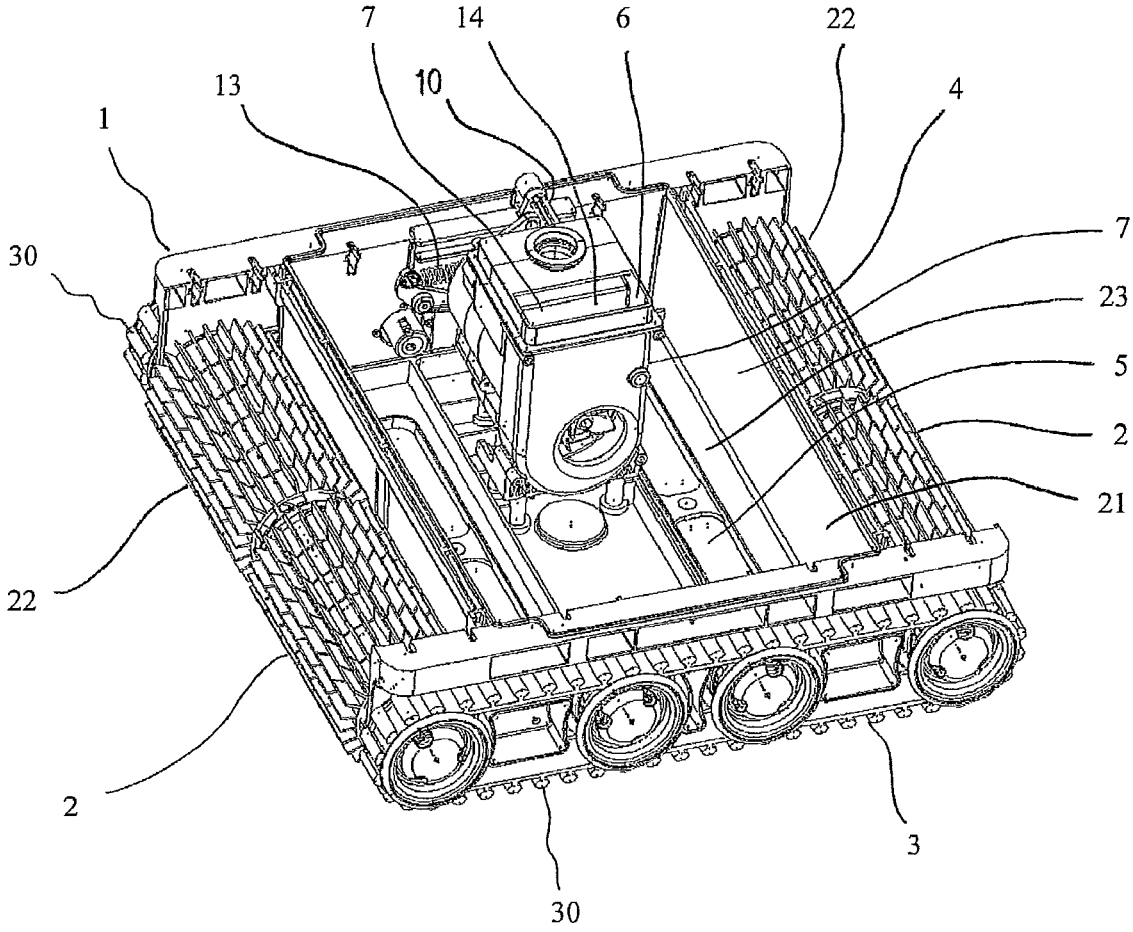
FIG. 2 represents a magnified partial view of the example of FIG. 1.

The robot 1 comprises an upper cowl 20 as shown in FIG. 1, this upper cowl having been removed in FIG. 2 so as to show the interior of the robot 1 and the chassis 21 of the latter.

The upper cowl 20, the chassis 21, and the displacement means 2 are of known type. In the example represented, the displacement means 2 comprise two rotary brushes 22 at the two longitudinal ends of the robot, linked laterally at their respective ends by two longitudinal caterpillars, as represented in FIG. 2. The surface of contact 3 of the robot with the surface of displacement of the swimming pool consists of the lower surface of the brushes 22, adopting substantially the form of two rectangular surfaces of transverse extension at each longitudinal end of the robot. The lateral caterpillars are designed for the negotiating of obstacles by the robot.

Figure 3:
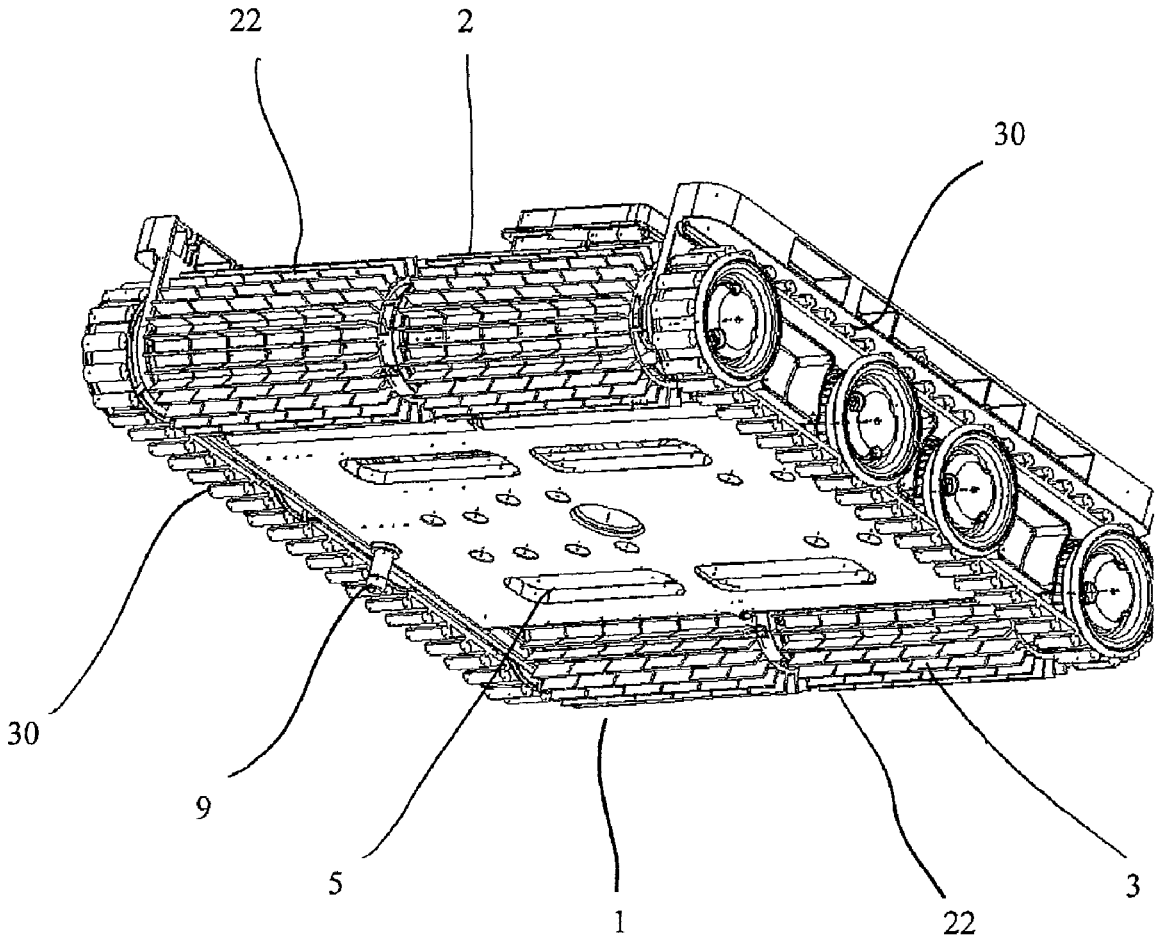
FIG. 3 represents a perspective overall view from below of the example of FIG. 1.

FIG. 3 shows in a view from below the strut 9 in the active position.

The aspiration opening 5 for sucking the fluid through the robot 1 is visible in FIGS. 2 and 3 and is situated for example on the chassis 21 between the two rotary brushes 22.

The discharge opening 6 for the aspirated fluid is made on the upper part of the robot 1, through the upper cowl 20 as represented in FIG. 1.

Between the aspiration opening 5 and the discharge opening 6 is situated the fluid conduit 7 which links these openings and which comprises means 8 generating a stream of the fluid in the conduit 7, an aspiration conduit 23 between the aspiration opening 5 and the generating means 8, and a discharge conduit 14 between the latter means and the discharge opening 6.

The means 8 generating a stream of the fluid in the conduit 7, consist of a hydraulic pump according to any known means, comprising a pump body 25, an inlet 26 and an outlet 27 of the pump body 25. The inlet 26 of the pump body 25 opens into the aspiration conduit 5 formed by an interior space of the robot 1 as represented in FIG. 2, in which the aspirated water is filtered, and the outlet 27 of the pump body 25 opens into the discharge conduit 14, the latter being, in the example represented, advantageously perpendicular or substantially perpendicular to the surface of contact 3 of the robot 1 with the displacement surface. In the example, the discharge conduit 14 is formed by the pump body 25 and the outlet 27 of the pump body corresponds to the discharge opening 6. The means 8 generating a stream of the fluid in the conduit 7 furthermore comprise in a known manner an electric motor 28 whose output shaft is connected to the pump turbine shaft.

The strut 9, in a known manner, is installed in the robot 1 laterally in a zone close to one of the caterpillars 30 or the lateral ends of the brushes, as represented in FIG. 3. In the example represented, the strut 9 preferably adopts the form of a rod of axis perpendicular to the contact surface 3, movable in translation in a guide 29 so as to be able to adopt the two positions, active and inactive, indicated above. In the example, the strut 9 is installed in the zone for installing the motor 28 as represented in the figures. The strut 9 when out, in the active position, raises one side of the robot 1 and lifts off the floor a caterpillar 30 and one side of the two brushes 22, their other side bearing on the displacement surface; the brushes 22 continuing to rotate, the robot 1 moves in rotation about the strut 9 which bears on the displacement surface in the active position.

In a preferential manner, as represented in FIG. 5 or 7, the means 10 for controlling the displacement of the strut 9 between its active and inactive positions, comprise means 11 for opposing the motion of the fluid in the fluid conduit 7 and which are movable in the latter so as to at least partially obstruct the conduit 7 or to clear it, and which are tied to the strut 9, in such a way that, depending on the position adopted in the fluid conduit 7 by these opposing means 11, the strut 9 takes its active or inactive position.

In a preferential manner, as represented in FIGS. 4 to 9, the means 11 for opposing the motion of the fluid in the fluid conduit 7 and which are movable in the latter and are tied to the strut 9, comprise:

movable-blade means 12, tied to the strut 9, and disposed in the fluid conduit 7 and movable between at least the following two positions:

a first so-called active position, adopted under the effect of a displacement of the fluid in the conduit 7 giving rise to an at least partial withdrawal of the movable-blade means 12 in this conduit 7, and in which the strut 9 is then in its inactive position retracted in the robot, this position being represented in FIG. 6 or 9, a second so-called inactive position, adopted when no fluid is moving in the conduit 7, giving rise, under the effect of an elastic restoring means 13, to a position of the movable-blade means 12 across the fluid conduit 7, and in which the strut 9 then stands proud in its active position, this position being represented in FIG. 5 or 7.

In a preferential manner, the means 11 for opposing the motion of the fluid in the conduit 7 are disposed in a part 14 of the fluid conduit 7, termed the discharge conduit 14, situated between the means 8 generating the fluid stream in the internal conduit 7 and the discharge opening 6, in the example directly in the pump body after the turbine as represented in FIGS. 5 to 9. Such a positioning of the opposing means makes it possible to use the maximum discharge pressure at the turbine outlet.

The movable-blade means 12 are preferably mounted rotatably in the fluid conduit 7, with a view to minimizing the load to be exerted for the displacement of the blade means 12 by the fluid.

The means 10 for controlling the displacement of the strut will now more particularly be described with the aid of FIGS. 5 to 9.

Figure 4:
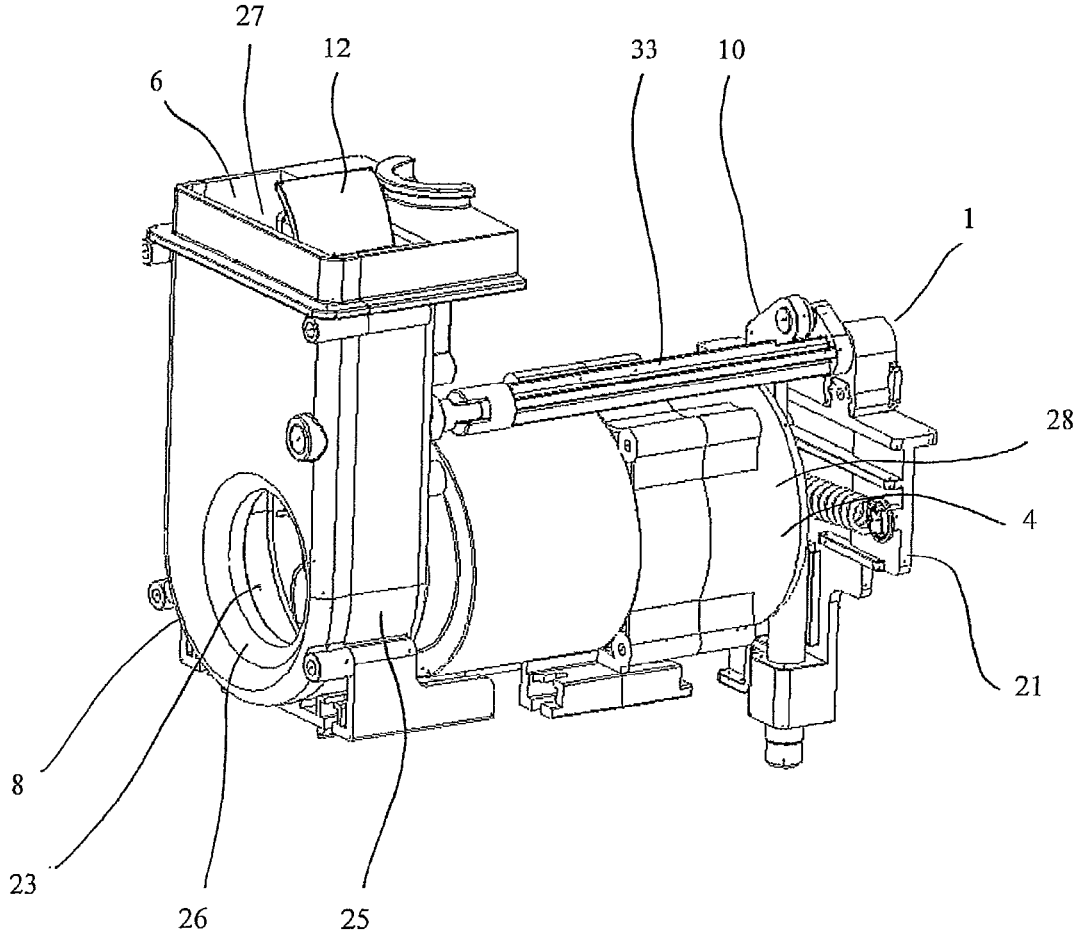
FIG. 4 represents a magnified detail in perspective of the example of FIG. 1, relating to the means generating a fluid stream through the robot.

The means 10 for controlling the displacement of the strut 9 between its active and inactive positions advantageously comprise, as for example represented in FIG. 4, an intermediate transmission link-bar 15 articulated at one 16 of its ends to the strut and at the other 17, opposite, of its ends, to the movable-blade means 12. The intermediate transmission link-bar 15 is furthermore preferably devised in such a way that the displacement of the strut 9 is degressive when the blade means 12 pass from their inactive position (FIG. 7) to their active position (FIG. 9).

Figure 8:
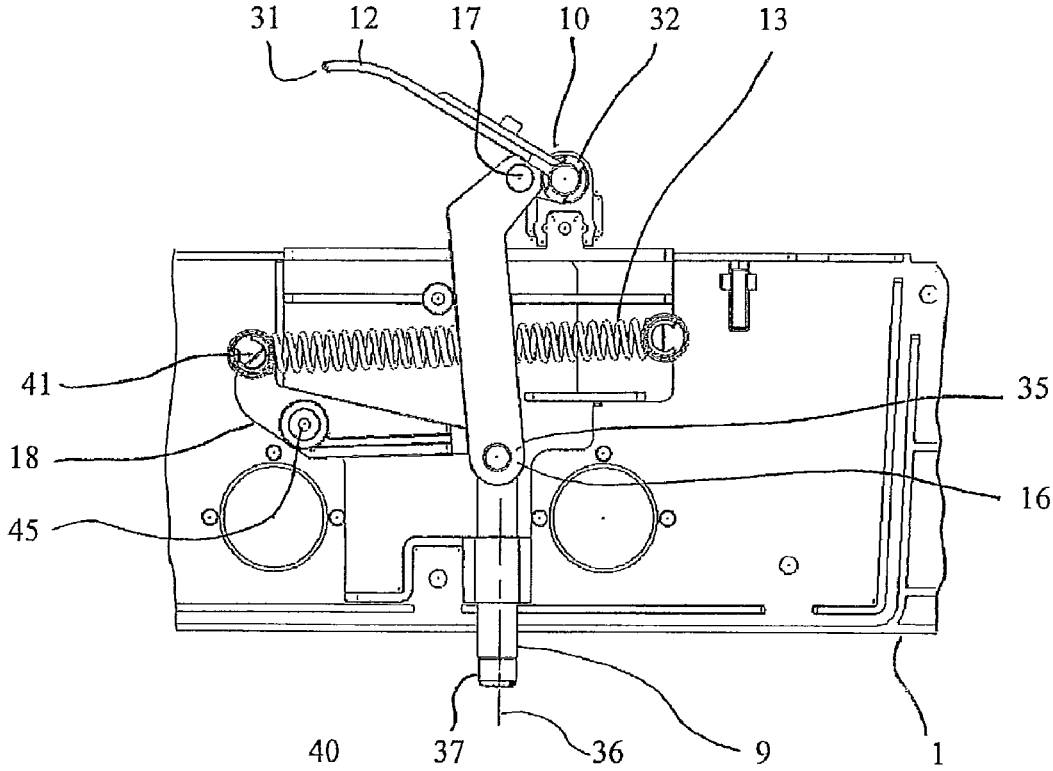

It should be noted that FIG. 8 represents an intermediate operating state of the strut 9 between the active and inactive position of the latter.

The blade means 12 advantageously adopt the form of a blade comprising a first curved free end 31 and a second end 32 opposite from the first, articulated in rotation to the pump body. At this second end 32 of the blade is fastened, by a rigid and complete link, a rod for transmitting the rotation motion generated by the blade 12 under the effect of the fluid flow in one direction or of the restoring spring 13 in the opposite direction. The periphery of the blade 12 adopts a form complementary to the cross section of the discharge conduit 14, in such a way that, when the plane of the blade 12 is perpendicular or substantially perpendicular to the longitudinal axis of the discharge conduit 14, in its inactive position, as represented in FIG. 5 or 7, the blade 12 entirely or almost entirely obstructs this discharge conduit 14. Thus, when the hydraulic pump is actuated, the fluid flow is set into motion in the discharge conduit 14 and thrusts the blade 12 back into its active position by making it pivot about its second end 32. The profile of the periphery of the blade 12 will be determined furthermore in such a way that this blade, under the effect of the flow, can move in the discharge conduit 14, in rotation in the example represented, so as to attain its active position in which it withdraws entirely or almost entirely from the cross section of the discharge conduit 14, as represented in FIG. 6 or 9, so that the flow can pass through this conduit with the least possible head loss on account of the presence of the blade 12, and thus exercise one of its main functions consisting in filtering the water in which the robot is moving. In the example, the blade 12 adopts a curved rectangular form at one of its longitudinal ends. This curvature advantageously makes it possible to apply the blade 9 in the active position firmly against the walls of the discharge conduit 7, so as to avoid, if appropriate, vibratory spurious displacements of this blade 12 when it no longer opposes the passage of the flow.

As represented in a manner more particularly visible in FIGS. 7 to 9, the intermediate transmission link-bar 15 is connected by a rotary link to the transmission rod 33 according to an axis of rotation which is very close to the axis of rotation of the rod so as to increase the load transmitted to the strut 9, by minimizing the lever between the axis of rotation of the rod 33 fastened to the blade 12, and the axis of rotation of the end 17 of the intermediate link-bar 15. The opposite end 16 of the intermediate link-bar 15 is connected by a rotary link to a first 35 end of the strut 9, preferably in the forward longitudinal axis 36 of translational thrust or traction of the latter in its guide 29. The second end 37 of the strut 9 is free and intended in a conventional manner to come into contact with the displacement surface in its active position, represented in FIG. 7 for example.

As represented in FIGS. 7 to 9, which more particularly show the kinematics of the control means 10 of the strut 9, in order to optimize the use of the energy provided by the fluid for the displacement of the strut, it is noted that, preferably, the axis of rotation between the rod 33 and the end 17 of the link-bar 15 is substantially in the plane of the blade 12 by projection in a plane comprising the longitudinal axis of the rod 33, so that the displacement transmitted by the link-bar 15 to the strut 9 to return the latter into the robot, is a maximum when the load of the flow on the blade 12 is a maximum; as the blade withdraws in the conduit 14, the load exerted on the blade by the flow decreases, as does the displacement of the link-bar 15 along the axis of displacement of the strut, and therefore also the translational displacement of the strut.

As represented in a manner more particularly visible in FIGS. 7 to 9, the means 10 for controlling the displacement of the strut 9 between its active and inactive positions advantageously furthermore comprise an intermediate transmission lever 18 between one of the elements, chosen from among the following: strut 9, intermediate link-bar 15, movable-blade means 12, and the elastic restoring means 13. In the example represented, a first end 40 of the intermediate lever 18 is for example in contact bearing on the extremity surface at the end 35 of the strut 9, while the other opposite end 41 of the intermediate lever 18 is tied to the elastic restoring means 13, in the example to a first end of a traction spring 13. The other end 42 of the traction spring 13 is for example attached to the chassis 21 of the robot 1. The intermediate lever 18 is for example articulated by a pivot link 45 to the chassis at points of the lever 18 and of the chassis which are defined, in cooperation with the point 42 of attachment of the spring 13 to the chassis 21, in such a way that the load for tensioning the elastic restoring means 13, exerted by the fluid on the blade means 12, is constant or substantially constant, when the latter move from their inactive position to their active position.

Indeed, when the blade means 12 passes from a position of obstruction of the conduit 14 to a position of withdrawal in this conduit, the loads exerted on the blade by the fluid are decreasing in order to be reduced to a residual load (defined by the curvature of the blade) when the blade is in the withdrawn active position, i.e. substantially in the direction of the streamlines of the fluid flowing in the conduit. Under these conditions, it is opportune that the intermediate lever 18 makes it possible to optimize this capture of energy in the flow, with the energy necessary to tension the traction spring 13 in the example, i.e. its extension, which is exerted and would normally increase throughout the extension of the spring, i.e. throughout the displacement of the blade 12 from its inactive position (FIG. 7) when the flow is halted at its active position (FIG. 9) after the flow has been re-established in the conduit 7. When the blade 12 arrives in the zone of its active position (FIG. 9), i.e. in its withdrawal position at the end of the opening of the conduit, the direction of the traction force of the spring 13 must preferably, according to the invention, approach the articulation 45 of the lever 18 on the chassis 21 so as to offset the increase in the load exerted by the spring on this lever 18, by maintaining constant or substantially constant the couple exerted by the spring on the lever 18, in this position zone of the blade 12.

It should be noted that in the example represented, all the rotation axes of the diverse elements described hereinabove and making up the control means 10 are parallel, and for example, perpendicular to the plane of the sheet wherein FIGS. 7 to 9 are represented.

All the components of the robot 1, with the exception of the electric motors and other fittings, spring if appropriate, or the like, may be made of plastic, and in particular all the components of the control means of the strut 9. The traction spring 13 may for example be made of stainless steel.

In FIG. 5, the arrows represent the direction of displacement of the elements in the operational phase considered, i.e. the placing of the strut in the active position (extraction).

In FIG. 6, the arrows represent the direction of displacement of the elements in the operational phase considered, i.e. the placing of the strut in the inactive position (extraction). The arrows furthermore show the direction of the fluid flow acting on the blade 12.

The robot 1 is powered via an electric cable (not represented) in any known manner.

The invention described makes it possible to obtain compact and lightweight means of control of the strut which do not require the provision of any dynamic or static waterproofing or any waterproof electrical link, thereby making the robot lighter and simpler.

The invention claimed is:

1. A motorized robot (1) for cleaning swimming pools or the like which operates submerged in a fluid, comprising:

displacement means (2) for the robot, of the wheel, brush, or caterpillar type, comprising a surface (3) of contact with a submerged surface of displacement of said swimming pool or the like, means (4) for generating, through the robot, a circulation of the fluid in which the robot is submerged, comprising:

an aspiration opening (5) for said fluid, a discharge opening (6) for the aspirated fluid, a fluid conduit (7) linking the aspiration and discharge openings, means (8) generating a stream of said fluid in said conduit, a strut (9) for lifting from the displacement surface, at least one part of said surface (3) of contact of the displacement means, said strut being movable at least between the following two positions:

a first position, termed the inactive position, in which said strut is retracted inside the robot, said surface (3) of contact of the displacement means then being able to be entirely in contact with said displacement surface, a second position, termed the active position, in which said strut stands proud of said surface (3) of contact of the displacement means, so that a part of this surface (3) of contact can no longer be in contact with the displacement surface, characterized in that said robot furthermore comprises means (10) for controlling the displacement of said strut which are activated by a motion of the fluid in said fluid conduit, said means (10) for controlling the displacement of said strut (9) between active and inactive positions comprising means (11) for opposing the motion of the fluid in the fluid conduit (7), which are movable in the fluid conduit (7) so as to at least partially obstruct said conduit or to clear the fluid conduit (7), and are tied to the strut, in such a way that, depending on the position adopted in the fluid conduit by said opposing means, the strut takes an active or inactive position.

2. The robot (1) as claimed in claim 1, characterized in that said means (11) for opposing the motion of the fluid in the fluid conduit (7), which are movable in the fluid conduit (7) and are tied to the strut (9), comprise:

movable-blade means (12), tied to the strut, and disposed in said fluid conduit, and movable between at least the following two positions:

a first so-called active position, adopted under the effect of a displacement of said fluid in the conduit giving rise to an at least partial withdrawal of the movable-blade means in the conduit, and in which said strut is then in an inactive position retracted in the robot, a second so-called inactive position, adopted when no fluid is moving in the conduit, giving rise, under the effect of an elastic restoring means (13), to a position of the movable-blade means across said fluid conduit, and in which said strut then stands proud in an active position.

3. The robot (1) as claimed in claim 2, characterized in that said movable-blade means (12) are mounted rotatably in the fluid conduit (7).

4. The robot (1) as claimed in claim 3, characterized in that the means (10) for controlling the displacement of the strut (9) between active and inactive positions comprise an intermediate transmission link-bar (15) articulated at one (16) end to the strut and at the other (17) end to said movable-blade means (12), and in that said intermediate transmission link-bar (15) is devised in such a way that the displacement of the strut (9) is degressive when the blade means (12) pass from an inactive position to an active position.

5. The robot (1) as claimed in, claim 4, characterized in that the means (10) for controlling the displacement of the strut (9) between active and inactive positions comprise an intermediate transmission lever (18) between one of the elements, chosen from among the following: strut (9), intermediate link-bar (15), movable-blade means (12), and said elastic restoring means (13), and in that said intermediate lever (18) is devised in such a way that the load for tensioning the elastic restoring means (13), exerted by the fluid on the blade means (12), is constant or substantially constant, when the blade means (12) move from an inactive position to an active position.

6. The robot (1) as claimed in claim 1, characterized in that said means (11) for opposing the motion of the fluid are disposed in a part (14) of the fluid conduit (7), termed the discharge conduit (14), situated between the means (8) generating the fluid stream in the conduit and the discharge opening (6).

7. The robot (1) as claimed in claim 6, characterized in that said discharge conduit (14) is perpendicular or substantially perpendicular to the contact surface (3) of the displacement means (2) for the robot.

* * * * *